US009097459B2

(12) United States Patent
Musicus

(10) Patent No.: US 9,097,459 B2
(45) Date of Patent: Aug. 4, 2015

(54) PRODUCTION OF HIGH-PRESSURE GASEOUS NITROGEN

(75) Inventor: Paul Musicus, Houston, TX (US)

(73) Assignee: Air Liquide Process & Construction, Inc., Houston, TX (US)

( * ) Notice: Subject to any disclaimer, the term of this patent is extended or adjusted under 35 U.S.C. 154(b) by 325 days.

(21) Appl. No.: 13/211,845

(22) Filed: Aug. 17, 2011

(65) Prior Publication Data

US 2013/0042646 A1 Feb. 21, 2013

(51) Int. Cl.
*F25J 3/08* (2006.01)
*F25J 3/04* (2006.01)

(52) U.S. Cl.
CPC ..... *F25J 3/04212* (2013.01); *F25J 3/04284* (2013.01); *F25J 3/04424* (2013.01); *F25J 2200/54* (2013.01); *F25J 2205/02* (2013.01); *F25J 2235/42* (2013.01); *F25J 2245/42* (2013.01)

(58) Field of Classification Search
CPC ... F25J 3/04406; F25J 3/04212; F25J 3/0443; F25J 3/04284; F25J 3/04412; F25J 3/04418; F25J 3/04424; F25J 2200/54; F25J 3/04206; F25J 3/02412; F25J 3/0469; F25J 3/04696; F25J 3/04703
USPC ..... 62/640, 643, 645, 648, 650
See application file for complete search history.

(56) References Cited

U.S. PATENT DOCUMENTS

| | | | | |
|---|---|---|---|---|
| 4,717,410 | A | 1/1988 | Grenier | |
| 5,098,457 | A * | 3/1992 | Cheung et al. | 62/646 |
| 5,251,449 | A * | 10/1993 | Rottmann | 62/651 |
| 5,402,647 | A * | 4/1995 | Bonaquist et al. | 62/651 |
| 5,421,166 | A | 6/1995 | Allam et al. | |
| 5,533,339 | A | 7/1996 | Clare et al. | |
| 5,560,223 | A | 10/1996 | Le Bihan | |
| 5,655,388 | A | 8/1997 | Bonaquist et al. | |
| 5,657,644 | A | 8/1997 | Oakey et al. | |
| 5,918,482 | A * | 7/1999 | Potempa | 62/646 |
| 5,956,973 | A * | 9/1999 | Herron et al. | 62/646 |
| 5,966,967 | A * | 10/1999 | Agrawal et al. | 62/650 |
| 6,009,723 | A * | 1/2000 | Fidkowski et al. | 62/649 |
| 6,141,989 | A | 11/2000 | Oakey | |
| 6,182,471 | B1 * | 2/2001 | Meagher | 62/646 |
| 6,330,812 | B2 * | 12/2001 | Mostello | 62/643 |

(Continued)

FOREIGN PATENT DOCUMENTS

WO WO2009136075 11/2009

*Primary Examiner* — Frantz Jules
*Assistant Examiner* — Brian King
(74) *Attorney, Agent, or Firm* — Justin K. Murray

(57) ABSTRACT

An improved process for producing elevated pressure nitrogen including providing an air separation unit with at least two columns, a low pressure (LP) column and a medium pressure (MP) column. Also including extracting a nitrogen stream from the MP column and extracting a rich liquid from the bottom of the MP column, and providing at least a portion of the rich liquid stream to a first vaporizer. Also including introducing a portion of the nitrogen stream into the first vaporizer, thereby producing a boil-off gas, and warming at least a portion of the nitrogen stream in a heat exchanger, thereby producing a product nitrogen stream. Also including warming at least a portion of the boil-off gas in the heat exchanger, thereby producing warm. intermediate stream, expanding the warm intermediate stream in an expander, thereby producing a quantity of work, and a low pressure intermediate stream, and introducing the low pressure intermediate stream into the LP column.

4 Claims, 1 Drawing Sheet

(56) References Cited

U.S. PATENT DOCUMENTS 6,397,631 B1 6/2002 Griffiths et al.
6,546,748 B1 4/2003 Kelly et al.
6,568,208 B1 5/2003 Fidkowski et al.
6,708,523 B2 * 3/2004 Lochner et al. ..... 62/643

* cited by examiner

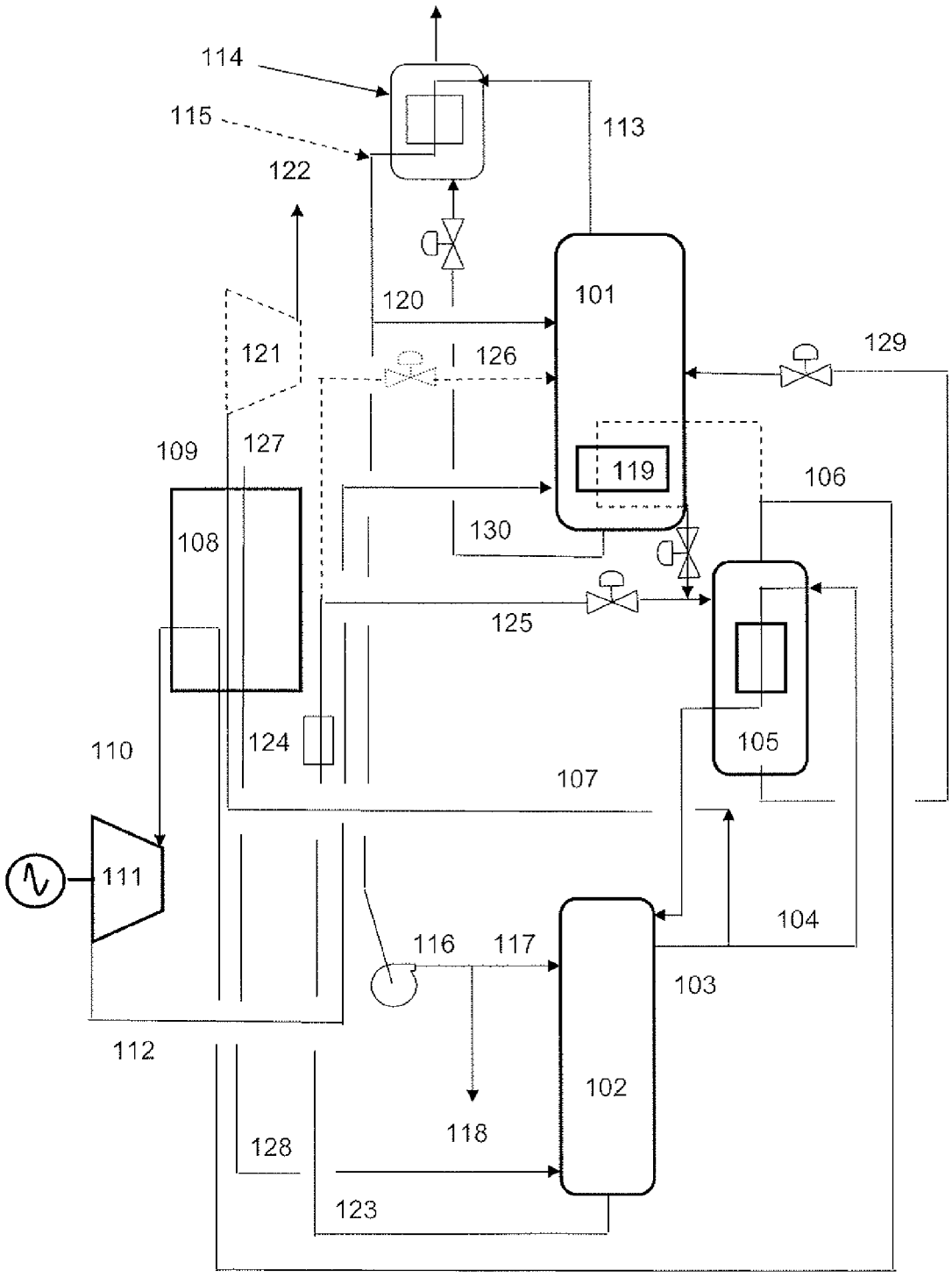
114
115
113
122
120
101
121
126
129
109
127
119
106
108
130
125
105
110
124
107
111
104
116
117
103
112
102
118
128
123

PRODUCTION OF HIGH-PRESSURE GASEOUS NITROGEN

FIELD OF INVENTION

The present invention relates to a process and an installation for producing nitrogen under pressure.

BACKGROUND

In installations for producing nitrogen under pressure, the nitrogen is usually produced directly at the pressure of use, for example between 5 and 10 bars. Purified air, compressed slightly above this pressure, is distilled so as to produce the nitrogen at the top of the column and the reflux is achieved by expansion of the "rich liquid" (liquid at the base of the column formed by air enriched with oxygen) and cooling of the condenser at the top of the column by means of this expanded liquid. The rich liquid is thus vaporized at a pressure of between about 3 and 6 bars.

If the size of the installation justifies this, the vaporized rich liquid is passed through an expansion turbine so as to maintain the installation in the cold state but, often, this refrigerating production is excessive, which corresponds to a loss of energy. In the opposite hypothesis, the cold state is maintained by an addition of liquid nitrogen coming from an exterior source, and the vaporized rich liquid is simply expanded in a valve and then travels through the thermal exchange line serving to cool the initial air. Consequently, here again, a part of the energy of the vaporized rich liquid is lost.

SUMMARY

The present invention is an improved process for producing elevated pressure nitrogen including providing an air separation unit with at least two columns, an LP column and an MP column. Also including extracting a nitrogen stream from said MP column and extracting a rich liquid from the bottom of said MP column, and providing at least a portion of said rich liquid stream to a first vaporizer. Also including introducing a portion of said nitrogen stream into said first vaporizer, thereby producing a boil-off gas, and warming at least a portion of said nitrogen stream in a heat exchanger, thereby producing a product nitrogen stream. Also including warming at least a portion of said boil-off gas in said heat exchanger, thereby producing warm intermediate stream, expanding said warm intermediate stream in an expander, thereby producing a quantity of work, and a low pressure intermediate stream, and introducing said low pressure intermediate stream into said LP column.

BRIEF DESCRIPTION OF THE FIGURES

FIG. 1 is a schematic representation of a portion of one embodiment of the present invention.

DESCRIPTION OF PREFERRED EMBODIMENTS

Illustrative embodiments of the invention are described below. While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

It will of course be appreciated that in the development of any such actual embodiment, numerous implementation-specific decisions must be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

Turning now to FIG. 1, a compressed, filtered, and precooled air stream 127 enters main heat exchanger 108 where it is cooled by indirect heat exchange with at least stream 107, thus producing cooled stream 128, which is then introduced into MP distillation column 102.

Rich liquid stream 123 is removed from the bottom of MP distillation column 102, passed through second auxiliary heat exchanger 124 where it is cooled, thereby producing cool rich liquid stream 125 and a second stream 126 may be introduced into LP column 101. Cool rich liquid stream 125 is then introduced into first vaporizer 105. Bottom stream 129 and top stream 106 are removed from first vaporizer 105. Bottom stream 129 is then sent to LP column 101. A portion of top stream 106 may be used to heat second vaporizer 119.

Second top stream 113 is sent to condenser 114, where it exchanges heat with second bottom stream 130. After the heat exchange, top stream 113 becomes cooled stream 115, at least a portion of which 120 is sent to LP column 101, and at least a portion 116 of which is increased in pressure. Pressurized stream 116 is split into a first portion 117 which is introduced into the MP column 102 and a second portion 118 is exported as liquid nitrogen product.

At least a portion of top stream 106 (boil-off gas stream) is heated in main heat exchanger 108, thereby producing warm intermediate stream 110. Warm intermediate stream is then expanded in expansion turbine 111, producing a quantity of work and a low pressure intermediate stream 112, which is then introduced into LP column 101.

Nitrogen stream 103 is extracted from the top of MP column 102, a portion of which 104 is directed to the first vaporizer to provide heat. A second portion of which 107 is warmed in main heat exchanger 108 and exported as product nitrogen 109. Stream 109 may be further pressurized in a product nitrogen compressor 121, thereby producing pressurized nitrogen product stream 122.

The particular embodiments disclosed above are illustrative only, as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below.

What is claimed is:

1. An air separation process for producing elevated pressure nitrogen using an air separation unit having a low pressure (LP) column, a medium pressure (MP) column, a first vaporizer, a main heat exchanger, a second vaporizer, a condenser and a first turbine, the process comprising the steps of:

introducing a cooled air stream to the MP column and conditions effective to separate the cooled air stream into a nitrogen enriched stream and an oxygen enriched stream;

withdrawing the nitrogen enriched stream from a top portion of the MP column;

withdrawing the oxygen enriched stream from a bottom portion of the MP column;

introducing the oxygen enriched stream to the first vaporizer for separation therein;

condensing the nitrogen enriched stream in the first vaporizer and then using the nitrogen enriched stream as reflux for the top of the MP column;

withdrawing a bottoms liquid stream from the first vaporizer and introducing said bottoms liquid stream into the LP column for separation therein;

withdrawing a boil-off gas from the top of the first vaporizer;

warming a first portion of the boil-off gas in the main heat exchanger to an intermediate temperature to produce an intermediate stream;

expanding the intermediate stream in the first turbine to produce a quantity of work and a low pressure intermediate stream, wherein the low pressure intermediate stream is at a temperature lower than the intermediate stream;

introducing the low pressure intermediate stream to the LP column for separation therein;

condensing a second portion of the boil-off gas within the second vaporizer, wherein the second vaporizer provides reboil duty for the LP column;

withdrawing a low pressure nitrogen stream from a top portion of the LP column;

condensing the low pressure nitrogen stream in the condenser to produce a cooled nitrogen stream;

pressurizing a first portion of the cooled nitrogen stream to produce a liquid nitrogen stream; and exporting a first portion of the liquid nitrogen stream as product.

2. The process of claim 1, further comprising the step of introducing a second portion of the liquid nitrogen stream into the MP column for separation therein.

3. The process of claim 1, further comprising the step of introducing a second portion of the cooled nitrogen strew into the LP column for separation therein.

4. The process of claim 1, wherein the boil-off gas has an increased concentration of oxygen as compared to the air stream.

* * * * *